US005842758A

United States Patent [19]

Kelley

[11] Patent Number: 5,842,758

[45] Date of Patent: Dec. 1, 1998

[54] SKY CABINET WORK STATION

[76] Inventor: James O. Kelley, 19130 N. Shore Dr., Spring Lake, Mich. 49456

[21] Appl. No.: 729,049

[22] Filed: Oct. 10, 1996

Related U.S. Application Data

[63] Continuation-in-part of Ser. No. 61,065, Sep. 6, 1996, which is a continuation-in-part of Ser. No. 428,530, Apr. 25, 1995, which is a continuation-in-part of Ser. No. 7,733, May 3, 1993, Pat. No. Des. 357,599.

[51] Int. Cl.[6] ..... A47B 63/04

[52] U.S. Cl. ..... 312/196; 312/223.3; 312/310; 312/223.6

[58] Field of Search ..... 312/196, 223.3, 312/194, 208.2, 239, 311, 295, 310, 223.6, 114

[56] References Cited

U.S. PATENT DOCUMENTS

| | | | |
|---|---|---|---|
| 448,372 | 3/1891 | Sabin | 312/310 |
| 791,512 | 6/1905 | Thomas | 312/310 |
| 842,780 | 1/1907 | Gardner | 312/310 |
| 2,566,256 | 8/1951 | Snyder | 312/315 |
| 2,769,676 | 11/1956 | Larsen et al. | 312/310 |
| 3,078,133 | 2/1963 | Schauer | 312/310 |
| 4,669,790 | 6/1987 | Briggs | 312/223.3 |
| 4,824,190 | 4/1989 | Barlett et al. | 312/138 R |
| 5,558,418 | 9/1996 | Lambright et al. | 312/223.3 X |
| 5,586,816 | 12/1996 | Geiss, II | 312/310 X |

*Primary Examiner*—Peter M. Cuomo
*Assistant Examiner*—Stephen Vu
*Attorney, Agent, or Firm*—Waters & Morse, P.C.

[57] ABSTRACT

A work station desk has a pair of opposing side panels that are generally vertically oriented elongated members. The side panels are generally parallel to and spaced laterally from one another. A work surface is supported above a floor, by the side panels. Further, a top is supported above the work surface, by the side panels. The top has a transparent or translucent panel that is adapted to transmit light through the panel to illuminate the work surface and the work station. A perimeter frame supports the panel in the top.

22 Claims, 4 Drawing Sheets

SKY CABINET WORK STATION

CROSS-REFERENCES TO RELATED APPLICATIONS

This is a continuation-in-part application of U.S. patent application Ser. No. 29/061,065, entitled Work Station and filed on Sep. 3, 1996 now U.S. Pat. No. D 388,637, by James O. Kelley and Michael D. Warren, the disclosure of which is incorporated here by reference; which is a continuation-in-part of patent application Ser. No. 08/428,530, entitled Concealed Desk and filed on Apr. 25, 1995, now U.S. Pat. No. 5,678,905, by James O. Kelley, the disclosure of which is incorporated here by reference; which is a continuation-in-part of co-pending patent applications Ser. No. 29/007,733, filed on May 3, 1993, now U.S. Pat. No. D 357,599, entitled Computer Workstation and issued on Apr. 25, 1995 to James O. Kelley, the disclosure of which is incorporated here by reference; Ser. No. 29/037,658, entitled Computer Secretary and filed on Apr. 17, 1995, now U.S. Pat. No. D 376,491, by James O. Kelley and Michael D. Warren, the disclosure of which is incorporated here by reference; and Ser. No. 29/037,654, entitled Computer Workplace and filed on Apr. 17, 1995, now U.S. Pat. No. D 376,496, by James O. Kelley, the disclosure of which is incorporated here by reference.

BACKGROUND OF THE INVENTION

The invention relates to a desk in which the front of the desk is enclosed to conceal the presence of a desk and make the desk appear to be a storage cabinet other than a desk. Conversely, the front of the desk may be opened to reveal the desk and make the desk accessible to a user.

The presence of an office in the home is an established and widely accepted trend. A home office may be used for household finances, for doing out of the house business work at home, and for conducting a business from a home. Also, an ever increasingly popular home function is the use or operation of a computer in the home. Home offices typically require and include desk, storage (including file storage, and drawer space, for example), and computer features.

With space in many homes and most apartments being at a premium, dedicating a room solely as a home office is often not possible. Even when a home or an apartment is spacious enough to provide a dedicated home office, it is very desirable that the furnishings of the home office have a more warm and home appropriate appearance than conventional office furnishings commonly provide. Thus, it is desirable to incorporate desk, storage, and computer features into a furniture unit that closes to appear to be a conventional home storage cabinet and conceal the fact that the unit is actually a desk work station. A furniture unit that is a useful home office work station may appear oppressively large, however, and may present challenges regarding proper lighting of the work station and room lighting as well.

SUMMARY OF THE INVENTION

A work station desk according to the present invention has a pair of opposing side panels that are generally vertically oriented and spaced laterally from one another. The side panels support a top above a floor. The top has a translucent panel that is adapted to transmit light through the panel. The top also has a perimeter frame that circumscribes the panel. A work surface or desk top is also supported by the side panels and is supported between the top and the floor. The side panels, the work surface, and the floor define a kneehole to receive the legs of a user who is seated at the desk. A door is hingedly connected with one of the first and second side panels to swing between an open and a closed position. In the open position, the desk is accessible for use by the user. In the closed position, the door overlays the front of the desk and conceals the desk to give it an appearance of a storage cabinet other than a desk.

In one aspect of the invention, a shelf is located between the top and the work surface, and extends at least partially between the first and second side panels. Further, a drawer may be slidably connected with one of the first and second side panels. The drawer may be positioned to extend at least partially between the work surface and the floor. Also, the desk may include a keyboard drawer that is located below and adjacent the work surface, and which extends at least partially between the first and second side panels.

In other aspects of the invention, the desk may have two doors hingedly connected with front edges of the side panels, each of the doors extending from the top to near the floor and swinging between the open and closed positions. Further, each of the two side panels may have a lower portion that extends downward from the work surface to support the work surface above the floor and have an upper portion that extends upward from the work surface to support the top above the work surface. Each of the two doors may also have a lower door portion that extends downward from the work surface and have an upper door portion that extends upward from the work surface.

These and other features, objects, and benefits of the invention will be recognized by one having ordinary skill in the art, from the specification, the claims, and the drawing figures.

DESCRIPTION OF THE PREFERRED EMBODIMENTS

Figure 1:
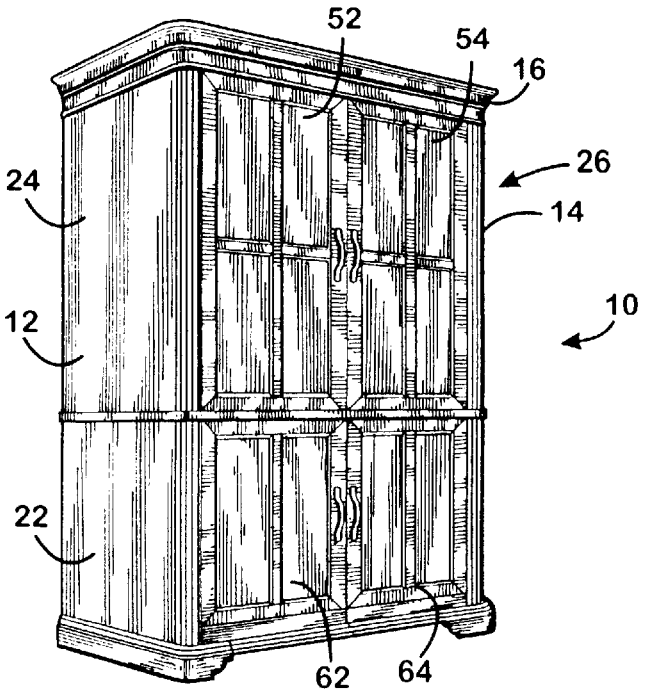
FIG. 1 is a front perspective view of a work station according to the invention.
Figure 2:
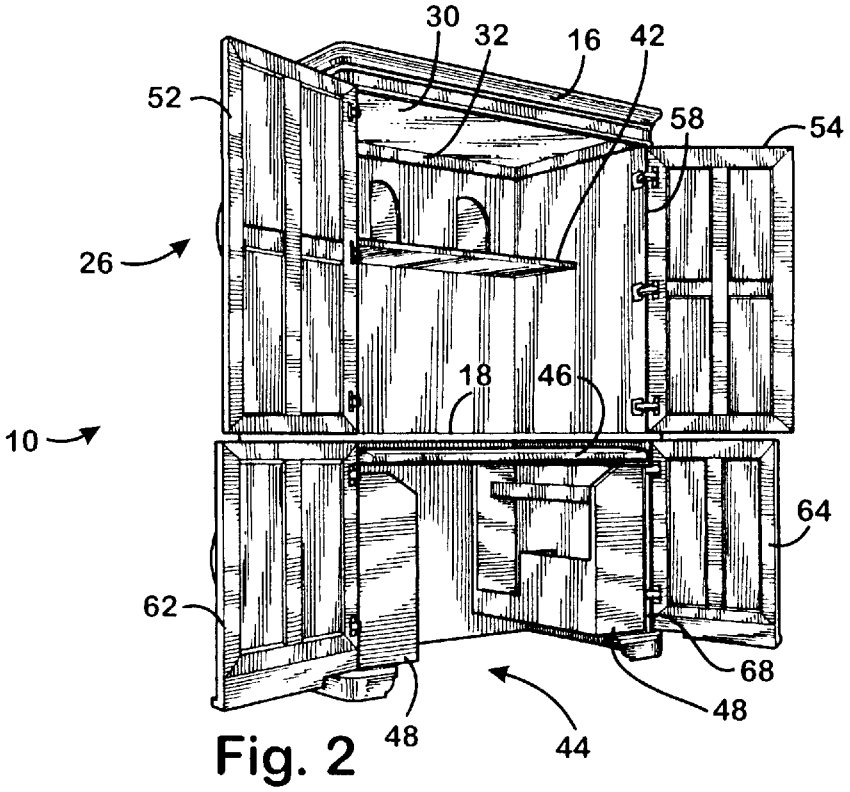
FIG. 2 is the view of FIG. 1, showing the doors of the work station open.
Figure 3:
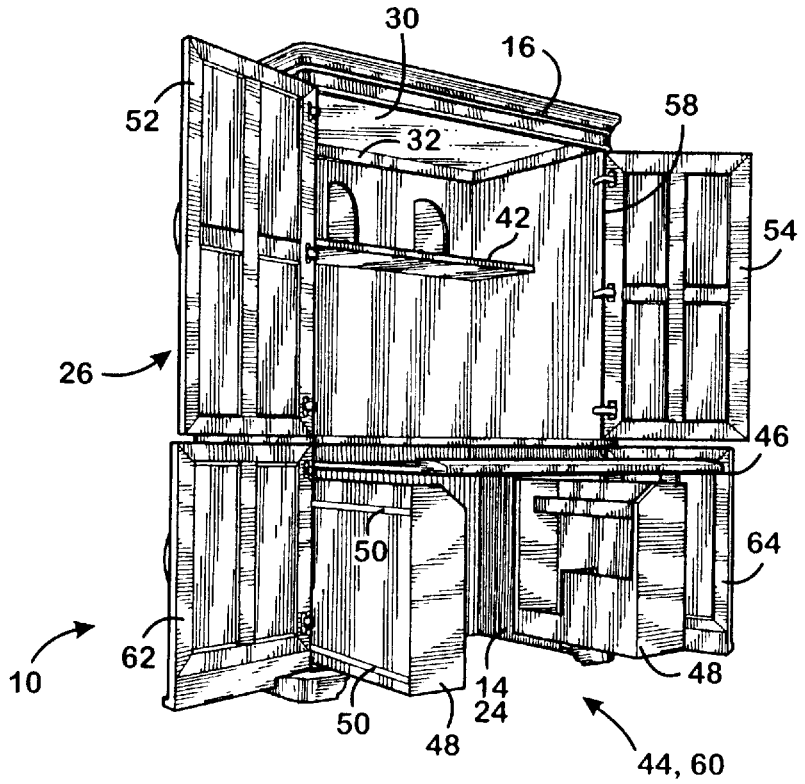
FIG. 3 is the view of FIG. 1 showing the doors and the drawers of the work station open.

A preferred embodiment of a desk work station 10 with a skylight is generally shown in the drawing FIGS. 1–8. The desk 10 has a pair of side panels 12 and 14 that support a top 16 and a work surface or desk top 18.

More particularly, the side panels 12 and 14 are elongated members that extend generally vertically upward from a support floor. The side panels 12 and 14 are laterally spaced apart and are generally parallel with one another. Each side panel, 12 and 14, may be constructed of any suitable material and by any suitable method as are known in the furniture making trades. Further, each of the side panels, 12 and 14, may be constructed with a lower portion 22 and an upper portion 24. The lower panel portion 22 extends downward from the work surface 18 to support the work surface above the floor. Conversely, the upper panel portion 24 extends upward from the work surface 18 to support the top 16, which may be considered a hutch top that, in combination with the upper panel portion 24 of each side panel 12 and 14, defines an upper desk portion or hutch portion 26.

As is seen in the drawing FIGS. 2, 3, 6, and 8, the hutch top 16 has a light transmitting panel 30 and a perimeter frame 32 circumscribing the panel. The panel 30 may be fabricated of any suitable material, including plastics and glass, for example, to transmit light through the panel and facilitate illumination of the hutch 26 and work surface 10. The frame 32 may be constructed of a series of cleats that extend along the side panels 12 and 14 and the front and back of the hutch top 16. As discussed regarding the side panels 12 and 14, above, the cleats may also be constructed of any suitable material and by any suitable method as are known by the furniture making trades.

Figure 9:
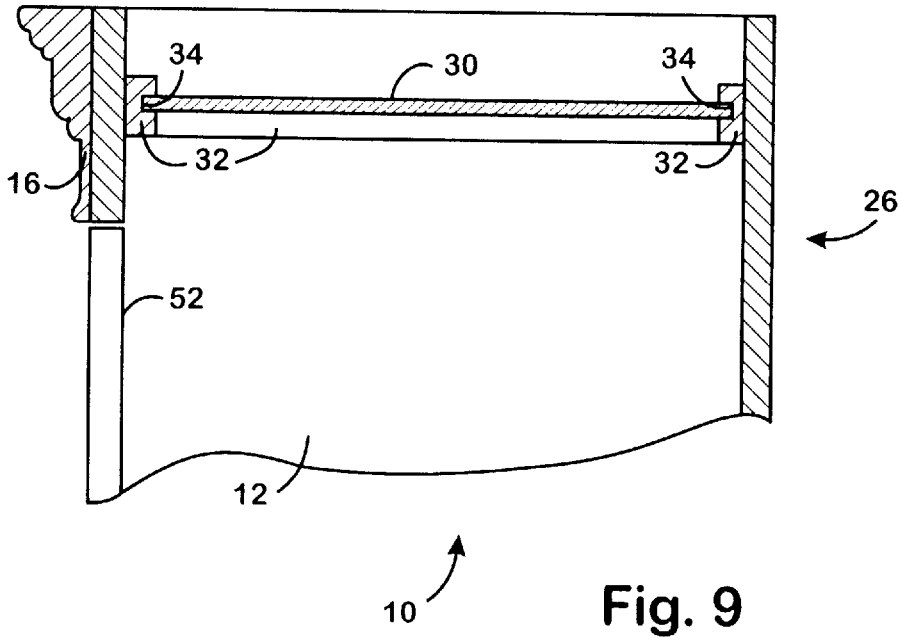
FIG. 9 is the view of FIG. 8, showing an alternative perimeter frame.
Figure 4:
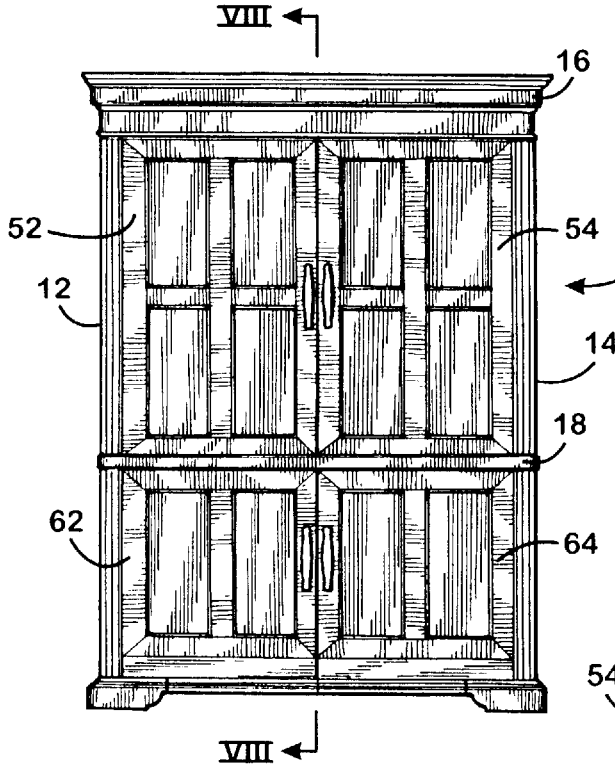
FIG. 4 is a front elevational view thereof, with the drawers and doors closed.
Figure 5:
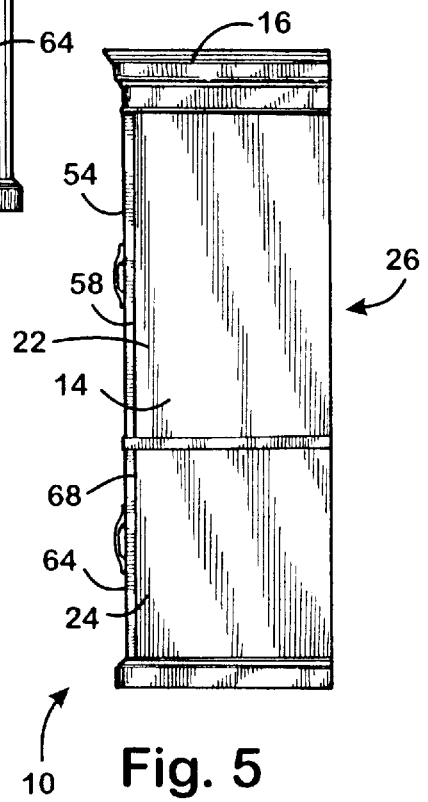
FIG. 5 is a right side elevational view thereof, the left side elevational view being a mirror image thereof.
Figure 6:
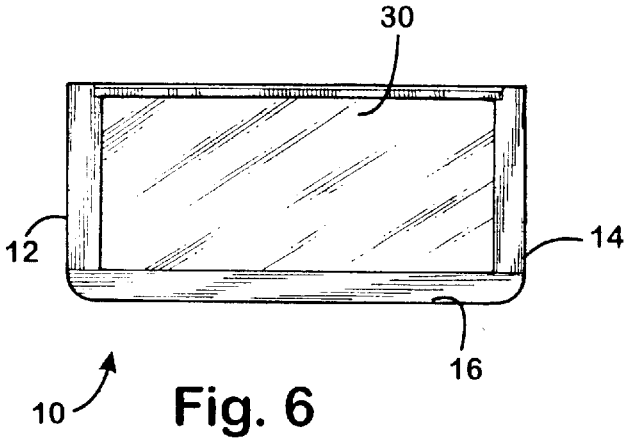
FIG. 6 is a top plan view thereof.
Figure 7:
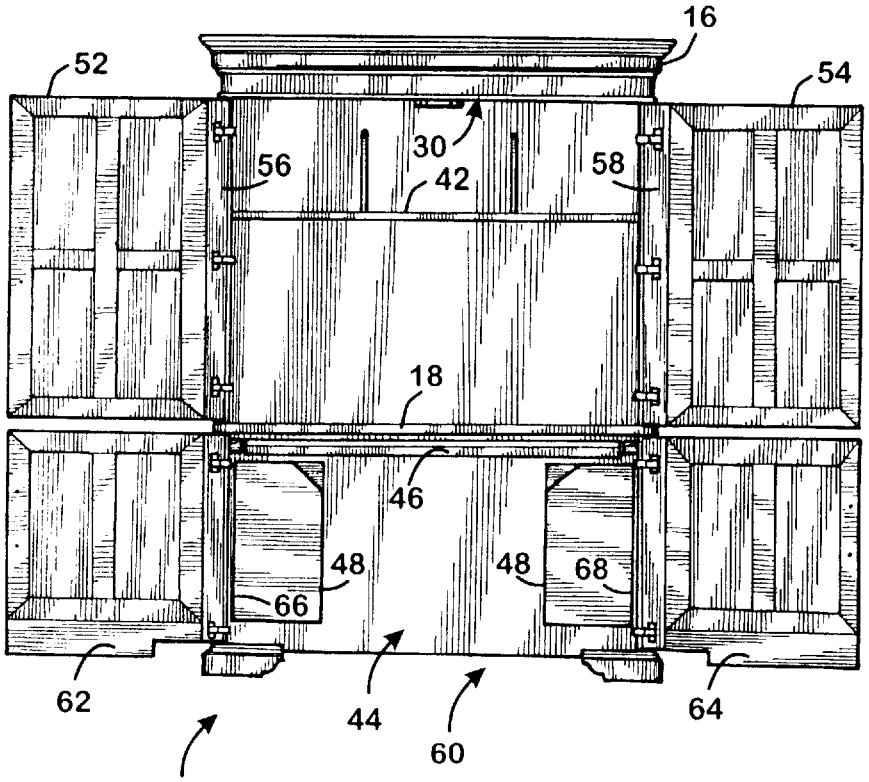
FIG. 7 is the view of FIG. 4, with the doors open.
Figure 8:
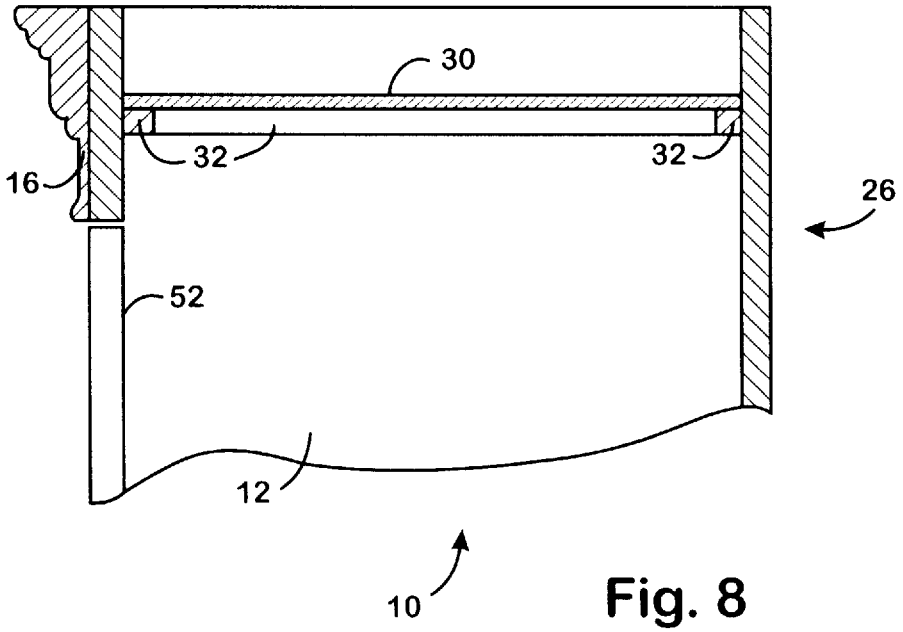
FIG. 8 is a fragmentary cross-sectional view along line VIII—VIII of FIG. 4.

The panel 30 is sized to set on top of the cleats that define frame 32. Alternatively, the perimeter frame 32 may be constructed to extend around a perimeter edge 34 (FIG. 9) of the panel 30, between a top surface 36 and a bottom surface 38 of the panel 30. Such a construction of the perimeter frame 32 would, however, be more difficult and more costly in production.

Provision may be made for a shelf 42 in the upper desk portion 26. The shelf 42 may be either fixed or adjustable, as is known by one having ordinary skill in the art, and will extend at least partially between the side panels 12 and 14. Again as discussed regarding the side panels 12 and 14, above, the shelf 42 may be constructed of any suitable material and by any suitable method as are known by one having ordinary skill in the art.

The work surface 18 is supported above the floor by the side panels 12 and 14. More particularly, the work surface 18 may be constructed of any suitable material and by any suitable method as are known by one having ordinary skill in the art, and may be fastened with the side panels 12 and 14, at a fixed position. Alternatively, connection of the work surface 18 with the side panels 12 and 14 may be adjustable to provide a comfortable workplace for a variety of users.

The work surface 18 and the lower portions 22 of side panels 12 and 14 define a kneehole 44 opening therebetween and above the floor, to receive the legs of a user, who is seated at the desk 10. To further facilitate working at the desk, a keyboard drawer 46 or the like may be provided under and adjacent to the work surface 18. The keyboard drawer 46 will extend partially between the lower portions 22 of the side panels 12 and 14. The keyboard drawer 46 may be attached to the side panels 12 and 14, or may be attached to the work surface 18. The keyboard drawer 46 may also be mounted to be adjustable, as is discussed above regarding the work surface 18. It is noted that if the keyboard drawer 46 is attached to the work surface 18, then it will automatically be adjustable with the work surface 18.

Drawers or other storage compartments 48 may be slidably or otherwise attached to the side panels 12 and 14. Each sliding drawer 48 is preferably mounted to one of the side panels 12 and 14, with slide tracks 50 in what may be termed a saddle drawer configuration to minimize the amount of space that is occupied by desk structure and to maximize utilization by the user. The saddle drawer configuration is contrasted with traditional drawer support in which a drawer is supported between a pair of support panels with a slide track interconnecting the drawer and one support panel, on one side of the drawer, and another slide track interconnecting the drawer and the second, opposing, support panel, on the other, opposing, side of the drawer, as is known by one having ordinary skill in the art.

The drawers 48 may be located below the work surface 18 and extend at least partially between the work surface 18 and the floor, in the kneehole opening 44. The drawers 48 may also be seen to further define a width of the kneehole opening 44 between the drawers 48. Further, as is discussed above regarding the work surface 18, the drawers 48 may be mounted to be adjustable.

Two upper doors 52 and 54 may be hingedly connected with front edges 56 and 58 of the upper portions 24 of the side panels 12 and 14. The doors 52 and 54 will most preferably swing between a closed position in which the doors overlay the front of the hutch 26 to conceal the desk 10 and to give an appearance of a storage cabinet other than a desk, and an open position in which the hutch 26 is accessible by a user. A pair of lower doors 62 and 64 are also preferably hingedly attached with front edges 66 and 68 of each of the lower portions 22 of the side panels 12 and 14, to swing between an open position in which the desk 10 is accessible by a user, and a closed position in which the doors 62 and 64 overlay the front of the desk 10 to conceal the desk and give the desk an appearance of a storage cabinet other than a desk. Alternatively, upper door 52 and lower door 62 may be constructed as one unit and upper door 54 and lower door 64 may also be constructed as one unit so that two doors that extend from the top 16 to near the floor are hingedly attached with the front edges of the side panels 12 and 14 to swing between the open and closed positions, to open or close the desk as discussed above.

Thus, a desk workstation 10 according to the invention presents the appearance of a home storage cabinet, other than a desk, when the drawers 48 and the doors 52, 54, 62 and 64 are closed. In use, the doors 52, 54, 62 and 64 are opened for ready access to the work surface 18 and other storage features, including the drawers 48 and shelf 42, for example. Further, the desk 10 is unobstructed at the floor level 60 for open, barrier free, access from the front of the desk 10, to under the work surface 18, including kneehole 44. The open access to the desk enhances user convenience and allows a seating unit (not shown) to be stored in the kneehole 44. One such seating unit that works particularly well is a foldable chair as disclosed in the commonly assigned U.S. Pat. No. 5,335,971, entitled FOLDABLE CHAIR, and issued on Aug. 9, 1994 to James O. Kelley, the disclosure of which is incorporated here by reference.

It will be understood by one having ordinary skill in the art, that various modifications and improvements may be made without departing from the spirit of the disclosed concept. The scope of protection afforded is to be determined by the claims and by the breadth of interpretation allowed by law.

I claim:

1. A desk with a storage hutch, said desk and storage hutch having a front and an opposing back, the desk and storage hutch comprising:

a first side panel and a second side panel, each of said first and said second side panels being an elongated member that extends generally vertically, said first and said second side panels being spaced apart and being oriented generally parallel to one another;

a work surface supported above a floor by said first and said second side panels, said first and said second side panels and said work surface defining a kneehole to receive the legs of a user seated at said desk;

a top supported above said work surface by said first and said second side panels, said top having a generally horizontal perimeter defining an opening, said opening extending between said front and said back and between said first and said second side panels, said top also having a cooperating light transmitting panel that is supported by said frame and closes said opening, said panel being adapted to transmit ambient light to said work surface; and a door hingedly connected with one of said first and said second side panels to swing between an open position in which said desk is accessible by a user, and a closed position in which said door overlays the front of said desk to conceal said desk and give said desk an appearance of a storage cabinet other than a desk.

2. The desk defined in claim 1 further including a shelf that is located between said top and said work surface, said shelf extending at least partially between said first and said second side panels.

3. The desk defined in claim 2 further including a drawer slidably connected with one of said first and said second side panels.

4. The desk defined in claim 3 further including a keyboard drawer that is located below and adjacent said work surface, said keyboard drawer extending at least partially between said first and said second side panels.

5. The desk defined in claim 4 wherein said drawer slidably connected with one of said first and said second side panels extends between said work surface and the floor.

6. The desk defined in claim 3 wherein said desk has a first door hingedly connected with a front edge of said first side panel, and has a second door hingedly connected with a front edge of said second side panel, each of said first and said second doors extending from said top to near said floor, so said first and said second doors swing between said open and said closed positions.

7. The desk defined in claim 6 wherein each of said first and said second doors has a lower door portion that extends downward from said work surface and has a separate upper door portion that extends upward from said work surface.

8. The desk defined in claim 6 wherein each of said first and said second side panels has a lower portion that extends downward from said work surface to support said work surface above the floor, and has an upper portion that extends upward from said work surface to support said top above said work surface.

9. The desk defined in claim 1 wherein each of said first and said second side panels has a lower portion that extends downward from said work surface to support said work surface above the floor, and has an upper portion that extends upward from said work surface to support said top above said work surface.

10. The desk defined in claim 9 wherein said desk has a first door hingedly connected with a front edge of said first side panel, and has a second door hingedly connected with a front edge of said second side panel, each of said first and said second doors extending from said top to near said floor, so said first and said second doors swing between said open and said closed positions.

11. The desk defined in claim 10 wherein each of said first and said second doors has a lower door portion that extends downward from said work surface and has a separate upper door portion that extends upward from said work surface.

12. A desk with a storage hutch, a front, and an opposing back, said desk and storage hutch comprising:

a first side panel and a second side panel, each of said first and said second side panels being an elongated member with a bottom end and an opposing top end, that extends generally vertically, said first and said second side panels being spaced apart and being oriented generally parallel to one another;

a work surface supported above a floor by said first and said second side panels, said first and said second side panels and said work surface defining a kneehole to receive the legs of a user seated at said desk;

a generally horizontal top supported above said work surface by said first and said second side panels, wherein a first portion of a said top defining a frame portion of said top being positioned second in said frame above said work surface and comprising a light transmitting material such that ambient light passes through said portion to said work surface; and a door hingedly connected with one of said first and said second side panels to swing between an open position in which said desk is accessible by a user, and a closed position in which said door overlays the front of said desk to conceal said desk and give said desk an appearance of a storage cabinet other than a desk.

13. The desk defined in claim 12 further including a shelf that is located between said top and said work surface, said shelf extending at least partially between said first and said second side panels.

14. The desk defined in claim 13 further including a drawer slidably connected with one of said first and said second side panels.

15. The desk defined in claim 14 further including a keyboard drawer that is located below and adjacent said work surface, said keyboard drawer extending at least partially between said first and said second side panels.

16. The desk defined in claim 15 wherein said drawer slidably connected with one of said first and said second side panels extends between said work surface and the floor.

17. The desk defined in claim 14 wherein said desk has a first door hingedly connected with a front edge of said first side panel, and has a second door hingedly connected with a front edge of said second side panel, each of said first and said second doors extending from said top to near said floor, so said first and said second doors swing between said open and said closed positions.

18. The desk defined in claim 17 wherein each of said first and said second doors has a lower door portion that extends downward from said work surface and has a separate upper door portion that extends upward from said work surface.

19. The desk defined in claim 17 wherein each of said first and said second side panels has a lower portion that extends downward from said work surface to support said work surface above the floor, and has an upper portion that extends upward from said work surface to support said top above said work surface.

20. The desk defined in claim 12 wherein each of said first and said second side panels has a lower portion that extends downward from said work surface to support said work surface above the floor, and has an upper portion that extends upward from said work surface to support said top above said work surface.

21. The desk defined in claim 20 wherein said desk has a first door hingedly connected with a front edge of said first side panel, and has a second door hingedly connected with a front edge of said second side panel, each of said first and said second doors extending from said top to near said floor, so said first and said second doors swing between said open and said closed positions.

22. The desk defined in claim 20 wherein each of said first and said second doors has a lower door portion that extends downward from said work surface and has a separate upper door portion that extends upward from said work surface.

* * * * *

UNITED STATES PATENT AND TRADEMARK OFFICE

CERTIFICATE OF CORRECTION

PATENT NO. : 5,842,758
DATED : Dec. 1, 1998
INVENTOR(S) : James O. Kelley

It is certified that error appears in the above-indentified patent and that said Letters Patent is hereby corrected as shown below:

In the Claims

Column 5, line 5, - - frame - - should be inserted after "horizontal perimeter"

Signed and Sealed this

Twenty-sixth Day of October, 1999

*Attest:*

Q. TODD DICKINSON

*Attesting Officer*

*Acting Commissioner of Patents and Trademarks*